United States Patent [19]

Wiley

[11] 4,395,137

[45] Jul. 26, 1983

[54] SYNCHRONIZING SYSTEM FOR OSCILLATING MECHANISM

[76] Inventor: Wallace F. Wiley, 9200 Elmonte, Prairie Village, Kans. 66207

[21] Appl. No.: 332,601

[22] Filed: Dec. 21, 1981

[51] Int. Cl.[3] ..... G04B 17/02; G04B 15/14; G04B 17/12

[52] U.S. Cl. ..... 368/179; 368/180; 368/181; 368/182

[58] Field of Search ..... 368/126, 134, 165, 166, 368/179, 180, 181, 182, 184

[56] References Cited

U.S. PATENT DOCUMENTS

| | | | |
|---|---|---|---|
| 754,398 | 3/1904 | Tiffany | 368/180 |
| 868,264 | 10/1907 | Guillaume | 368/180 |
| 3,360,920 | 1/1968 | Heim | 368/181 |
| 3,546,874 | 11/1968 | Booty et al. | 368/179 |
| 3,845,874 | 11/1974 | Holzmann | 368/179 X |
| 3,903,684 | 9/1975 | Wilson | 368/179 X |
| 4,020,624 | 5/1977 | Steine et al. | 368/181 |
| 4,038,588 | 7/1977 | Woolfson et al. | 368/179 X |
| 4,050,236 | 9/1977 | Jauch | 368/181 |
| 4,115,996 | 9/1978 | Coy | 368/181 |
| 4,139,981 | 2/1979 | Nozawa et al. | 368/179 X |
| 4,196,579 | 4/1980 | Schaefer | 368/181 |
| 4,203,282 | 5/1980 | Radzun | 368/180 |
| 4,228,533 | 10/1980 | Siefert | 368/179 X |
| 4,308,606 | 12/1981 | Fehrenbacher | 368/180 |

*Primary Examiner*—J. V. Truhe
*Assistant Examiner*—Terry Flower
*Attorney, Agent, or Firm*—Kokjer, Kircher, Bradley, Wharton, Bowman & Johnson

[57] ABSTRACT

A method and apparatus for accurately controlling a timekeeping apparatus utilizing a relatively heavy free pendulum or other harmonic structure carrying a permanent magnet, and a powered harmonic structure carrying a ferromagnetic element. The magnet is positioned on its carrier in a manner to effect energy transfer between the pendulums or structures during intermittent periods of magnetic attraction as the two structures oscillate. The free structure governs the speed of oscillation of the powered structure to maintain accurate control over the latter and energy transferred from the powered structure to the free structure maintains continued oscillation of the governing, free structure.

13 Claims, 5 Drawing Figures

SYNCHRONIZING SYSTEM FOR OSCILLATING MECHANISM

This invention pertains to timing systems and more particularly to a method and apparatus for enhancing the accuracy of clocks or similar mechanisms. Such oscillating devices are well suited for the purpose because they are capable of repeating their cyclic movements with great regularity. The recurring action of mechanical clocks are highly dependent upon this regularity to achieve the degree of accuracy which is desired. The oscillation is used to control the movement of the timekeeping mechanism through the action of an escapement which permits advancement of the mechanism only responsive to certain positions of the oscillating device.

Accordingly, the ultimate accuracy of the timekeeping mechanism depends primarily on the escapement. Many different kinds of escapement have been used and some lend themselves to greater accuracy than others. Nevertheless, all escapements are subject to certain irregularities or variations which result in inaccuracies in the timekeeping mechanism. Further causes for inaccuracies include variations in ambient temperature, extraneous motions and the like.

Various attempts have been made to improve the accuracy obtainable with the use of oscillatory control devices. One such attempt has been the use of means to compensate for temperature variations which affect the device. Another attempt involves the use of a free-pendulum to synchronize the oscillations of the pendulum which is directly connected to the clock mechanism through the escapement.

Probably the most successful and, therefore, the best known device of the free-pendulum type is the so called Shortt free-pendulum clock. This mechanism utilizes a master pendulum which is maintained in a nearly evacuated case located in a constant temperature remote environment. This free-pendulum is physically coupled with electromagnetic switching structure so that the free-pendulum controls a slave clock having its own pendulum and indicating apparatus. If the pendulum of the slave clock is not synchronized with the free-pendulum, an electric impulse operates electromagnetic devices in a manner to produce appropriate adjustment to the swing of the slave pendulum and consequent accurate adjustment of the clock. An electromagnet of the system is situated to cause periodic physical engagement of the free-pendulum to sustain the oscillatory movement of the latter.

One chief disadvantage of clocks of the Shortt type, substantially retarding their use, is that they are highly impractical for use by the ordinary clock owner. Further, the electromagnets and associated coupling structure are relatively expensive and difficult to maintain.

Applicant has discovered that proper synchronization between a free-pendulum and the pendulum of a clock mechanism can be achieved and reliably maintained to improve the timekeeping accuracy of the clock, through the use of a permanent magnet. When the pendulums are positioned to effect periodic specific magnetic coupling during their respective swings, an energy exchange between the pendulums during the time of such coupling permits precise control of the period of oscillation of the clock pendulum. This controlling or governing, when properly adjusted, can improve the accuracy of the clock many times over what would otherwise be attainable were the clock pendulum acting alone and without the synchronizing free-pendulum. Further, the same magnetic coupling which governs the clock pendulum provides for the exchange of energy from the mechanically driven clock pendulum to the free-pendulum to sustain the oscillating movement of the latter.

Insofar as applicant is aware, no one has heretofore suggested the use of a permanent magnet in this manner to achieve the energy exchange between pendulums for this purpose. It is contemplated that the principles of this invention are not limited to the synchronizing of pendulums, but are also applicable to the synchronizing of other harmonic motion devices such as balance wheels and the like.

It is a primary object of the present invention to provide a method and apparatus for synchronizing the oscillating mechanism of timekeeping apparatuses to enhance the accuracy thereof, which method and apparatus are relatively simple and straightforward and devoid of the deficiencies encountered with the methods and devices heretofore put forward for this purpose.

In the achievement of the foregoing object, it is another object of the present invention to provide structure utilizing a permanent magnet for generating a magnetic field to accomplish energy transfer between a free-oscillating member and a powered oscillating member to simply and effectively synchronize the oscillations for enhanced accuracy.

A yet further object of the present invention is to provide a manner of and structure for greatly improving the accuracy of a timekeeping device without a comensurate increase in the cost of fabricating the device.

Still another object of this invention is to provide structure where the place on the oscillating paths of travel of the pendulums at which energy is transferred between the pendulums may be quickly and easily adjusted to effect the desired synchronization of the pendulums.

Another object of this invention is to provide for a similar adjustment to the strength of the magnetic attraction between oscillating members so that the amount of energy which is transferred between the members may be adjusted to effect the synchronizing of the members.

These and other important aims and objectives of this invention will be further explained or will become apparent from the following explanation and description of the drawings, wherein.

Figure 1:
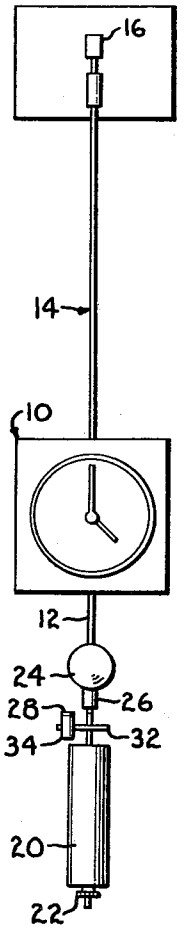
FIG. 1 is a front elevational view of a clock and free-pendulum embodying the principles of this invention.
Figure 2:
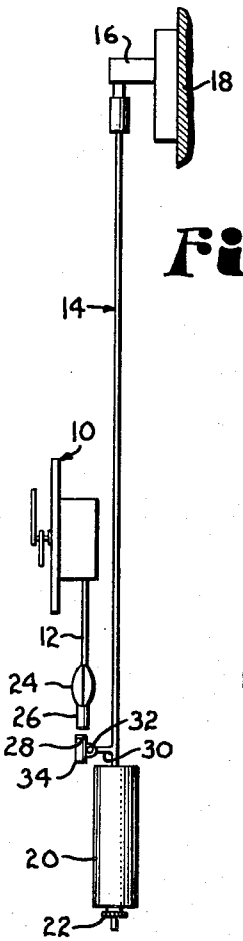
FIG. 2 is a side elevational view thereof.
Figure 3:
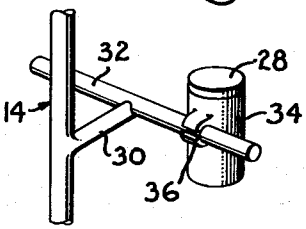
FIG. 3 is an enlarged, fragmentary rear perspective view of a device for adjustably mounting a permanent magnet to the free-pendulum of FIGS. 1 and 2.

Referring initially to FIGS. 1, 2 and 3, the synchronizing system embodying the principles of this invention includes a clock 10 of a type having a pendulum 12 which is powered by a spring and escapement mechanism (not shown) for oscillating the pendulum approximately in accordance with a predetermined period of oscillation as is well known in the timekeeping art. A free-pendulum broadly designated 14 is pivotally mounted by a device 16 to a surface 18 for harmonic swinging movement in generally close proximity to clock 10. The free-pendulum 14 has a relatively large bob 20 so that pendulum 14 has a mass which is greater than the mass of clock pendulum 12. The length of pendulum 14 is such that the harmonic motion of the latter has a period of oscillation which is substantially twice the duration of that of clock pendulum 12. Means such as nut 22 threaded on the pendulum rod is conventionally provided for varying the effective length of the pendulum as may be required for very precise adjustment of the period of oscillation. It is well known that the period of oscillation of a pendulum varies in accordance with the square root of its effective length and the shifting of the center of mass of the pendulum, for example by sliding bob 20 up or down the pendulum rod, adjusts the period of oscillation of the pendulum.

The lowermost end of clock pendulum 12, immediately below the bob 24 thereof is provided with a ferromagnetic element 26. This element may take the form of an integral portion of ferromagnetic material at the lowermost end of pendulum 12 or, in the alternative, may be a separate element which is securely fastened to the pendulum for swinging therewith. A permanent magnet 28 is adjustably mounted on free pendulum 14 for both lateral and vertical movement relative to the axis of the pendulum. A means for effecting such adjustable movement of the magnet is set forth for illustrative purposes and might include a T-shaped member comprising a projection 30 carried by the pendulum rod and an integral short laterally extending rod 32. Magnet 28 is slideably retained in a carrier 34 provided with a clip 36 engaged on rod 32 in a manner to permit the carrier to be positioned at any predetermined location longitudinally of the rod. Carrier 34 and magnet 28 may be of appropriate size so that the magnet is frictionally received within the carrier in telescoped relationship at any predetermined vertical disposition so that magnet 28 moves on the oscillatory path of travel of pendulum 14 into relatively closely spaced apart relationship with the ferromagnetic element 26 on pendulum 12. It will be readily apparent to those skilled in the art that other suitable devices might be utilized for adjustably mounting magnet 28 in the appropriate relationship with element 26 as may be required for operation of the synchronizing system.

In operation of the system the mechanism of clock 10 should be set to run slightly slower than the predetermined precise speed which is desired to be maintained in synchronized operation. Both the clock pendulum and the free-pendulum are placed in motion. The motion of the two pendulums, with the period of oscillation of the clock pendulum being approximately one half that of the free-pendulum, brings element 26 and magnet 28 into mutual magnetic attraction at periodic intravels. The location on the respective paths of travel of the pendulums where such mutual attraction occurs is subject to adjustment by moving magnet 28 in carrier 34 longitudinally along rod 32.

It has been found desirable for the location of magnet 28 be offset laterally from an imaginary vertical line interconnecting the two pendulums pivots. On the other hand, it has also been found that the longitudinal axes of the pendulums need not be in vertical alignment at the dead center positions. Rather, if desired, the axis of pivotal movement of pendulum 14 may be offset horizontally from the axis of pivoting of pendulum 12 to achieve beneficial results corresponding to those obtained by offsetting the magnet in installations where the pendulums axes are aligned at dead center. The degree of mutual magnetic attraction which occurs between magnet 28 and element 26 when the two components pass one another is adjustable by means of varying the spacing between the components. Obviously, if the parameters for proper synchronization of the two pendulums is such that a greater degree of magnetic attraction is required, magnet 28 is moved vertically in holder 34 so as to be closer to element 26 when the components pass one another as the pendulums oscillate. On the other hand, if less attraction is required, the magnet is simply lowered in its carrier to provide greater spacing between the components.

In any event, as the two pendulums oscillate on their respective paths of travel, the parameters of which are primarily determined by the inherent physical characteristics of the pendulums, the permanent magnet is repeatedly moved into and out of magnetic attraction with the ferromagnetic element. Positioning for mutual attraction between the two components carried by the two pendulums will occur twice during each oscillation of the free-pendulum since the powered or clock pendulum has a period of approximately one half that of the free-pendulum. One such position of mutual attraction between the component may be adjusted by proper positioning of the magnet so that it occurs near the dead center positions of the two pendulums and when the pendulums are travelling in opposite directions. The energy of the magnetic attraction between the pendulum carried components in this position has a substantially vertical component and does not materially affect the oscillations of the respective pendulums. On the other hand, the second position of mutual magnetic attraction of the components occurs at a position where the two pendulums are travelling generally in the same direction and, in accordance with the offset position of the magnet, may be adjusted to occur remote from the dead center pendulum positions.

It has been found that this latter position at which magnetic attraction occurs between the components can result in substantial synchronization of the pendulums. It is theorized that energy is transferred through the magnetic couple effected at this position such that the period of oscillation of the powered pendulum 12 may be governed by the period of oscillation of the free-pendulum 14 to effect the desired synchronization. Further, sufficient energy is also transferred through this magnetic coupling from the powered pendulum to impart the necessary power for continued oscillation of free-pendulum 14. If the natural oscillation of pendulum 12 is slightly slower than twice the period of oscillation of the free-pendulum, this energy transfer brings the actual period of oscillation of pendulum 12 into controlled relationship with that of the free-pendulum so that pendulum 12 oscillates virtually precisely twice as fast as pendulum 14.

Figure 4:
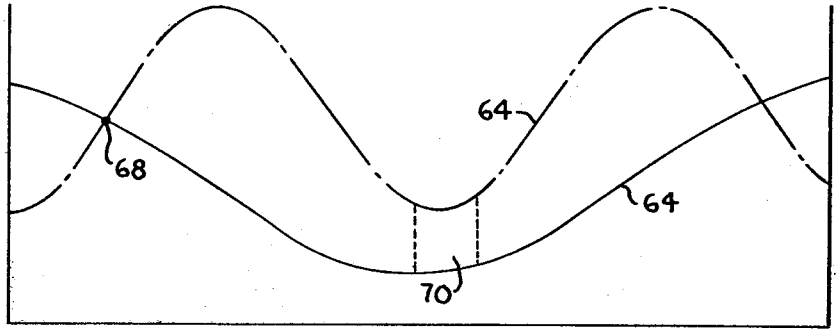
FIG. 4 is a diagram showing a plot of the oscillations of two pendulums such as are depicted in FIGS. 1 and 2 to illustrate a theory of operation of the synchronizing system of this invention.
Figure 5:
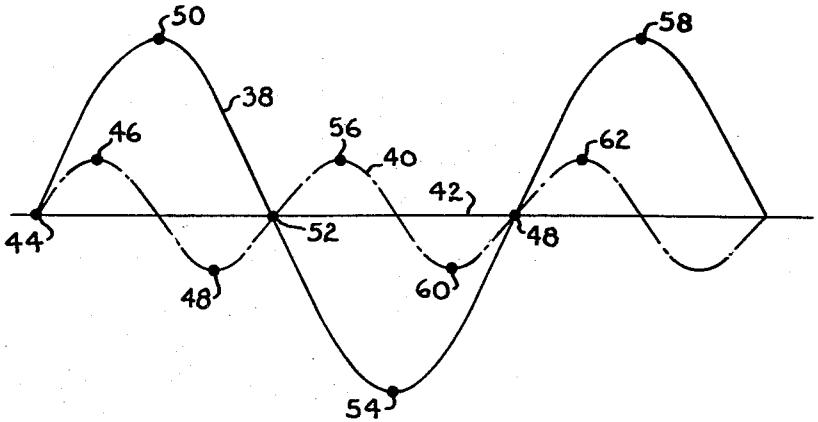
FIG. 5 is a diagram somewhat similar to FIG. 4 but showing a hypothetical pendulum and magnet relationship to simplify the explanation of the theory of operation of the system.

FIGS. 4 and 5 of the drawing are presented to graphically illustrate the theory as presently understood which explains the relationship between the two pendulums that applicant has found capable of effecting very accurate control of a clock pendulum. FIG. 5 is first set forth as an hypothetical representation of the oscillatory paths of travel of the two pendulums in a more or less idealized state and without the magnet having been offset from the aligned axis of pivoting movement of the two pendulums. Such an idealized representation is set forth only to assist in the explanation and does not represent any particular actual workable arrangement as will be described hereinafter. The solid line of FIG. 5 is designated by the numeral 38 and generally represents the oscillating path of travel of pendulum 14 wherein the amplitude of the swing is graphed vertically and time is graphed horizontally. The dash-dot line 40 generally represents the path of travel of pendulum 12. Line 42 represents the dead center axis of alignment of the pivots of the two pendulums. In the diagram of FIG. 5, pendulum 14 is assumed to have an amplitude of approximately three times that of pendulum 12 but the period of oscillation of pendulum 12 is shown to be twice that of pendulum 14. Accordingly, it may be assumed that both pendulums begin from a common starting point 44 in the dead center position. Pendulum 12 moves to point 46 at the extreme end of its path of travel in one direction and reverses direction to point 48 at the extreme other end of its path of travel. Meanwhile, pendulum 14 precedes on to point 50 before reversing directions and the pendulums do not assume a position of mutual magnetic attraction between the components of the magnetic coupling device until the dead center position 52 is reached with pendulum 14 moving toward point 54 representing the opposite end of its path of travel and pendulum 12 is moving toward point 56 which is at the same end of its path of travel as is represented by point 46. As the two components of the magnetic attracting device move past one another in opposite directions at the dead center position, it may be assumed that the effective result of any energy transfer between the components of the device will have little effect on the motions of the pendulums because of the essentially vertical direction of the component of force from such transfer at this location and because the two pendulums are travelling in opposite directions. On the other hand, when pendulums 14 is moving from point 54 to point 58, pendulum 12 is moving from point 60 to point 62 and pendulum 12 passes pendulum 14 at point 48. With both pendulums going in the same direction, all be it pendulum 12 is moving faster than pendulum 14, there is sufficient time for the magnetic coupling at this region to result in effective energy transfer for controlling the speed of the lighter pendulum 12 in accordance with the speed of the heavier pendulum 14. As heretofore explained, power from pendulum 12 which is driven by the clock mechanism is also transferred to pendulum 14 to assure the continued oscillation of the latter.

It has been discovered imperically that the positions or relationships of the various structures which would produce the idealized motion graph illustrated in FIG. 5 do not work very well in actual practice. Thus, it has been found that better synchronizing results are obtained if magnet 28 is offset from vertical alignment of the respective axes of pivot as heretofore explained. FIG. 4 illustrates diagrammatically the pendulum movements of a relationship which has been found to be particularly well suited to maintain extremely accurate synchronization of the clock mechanism with the free-pendulum. In this illustration, solid line 64 represents the path of oscillatory movement of the free-pendulum charted against time. The dash-dot line 66 represents in similar fashion the path of movement of the clock pendulum 12, and it may be observed that the latter pendulum oscillates twice as fast as pendulum 14 but the amplitudes of oscillation of both pendulums in this illustration are very nearly the same. In this case, however, due to the offset relationship of magnet 28 with respect to the axes of pivot of the pendulums, the zone of magnetic coupling between the two pendulums does not occur both times at the dead center position for the pendulums as in the case of the hypothetical situation illustrated in FIG. 5. Magnet 28 does pass beneath element 26 at point 68 on the chart which represents an approximate dead center position with the two pendulums passing in opposite directions. However, these two pendulums again reach the point of magnetic energy transfer in the region designated 70 bounded by the two parallel vertical dash lines in FIG. 4. Note that both pendulums are travelling generally in the same direction at this region and are at the approximate end of their respective paths of travel. It has been found in actual practice that ample energy transfer occurs between the pendulums in the vicinity of region 70 to impose governing control over pendulum 12 and, at the same time, assure continued oscillatory movement of pendulum 14.

It should be pointed out at this juncture that the charts shown in FIGS. 4 and 5 are presented for the purpose of explaining the theory of operation of the invention as presently understood by applicant. That the invention works as an effective synchronizing system has been demonstrated but the actual functioning of the various components to produce such synchronization is complex and still subject to a certain amount of theorization. It has been observed that the zone of energy transfer between the pendulums may be transitory and may in fact "hunt" during the oscillation of the pendulums. However, and independently of whether or not the theory herein advanced as to how synchronization control is effected between the pendulums, it has been found that such control can be effected with structure as described herein and that such control markedly improves the accuracy which is otherwise obtainable with mechanical clocks provided with conventional escape mechanisms. The precise location and spacing of magnet 28 from element 26 can be arrived at through a reasonable amount of experimentation and fine tuning of the apparatus. It has been found desirable, however, to have the magnet offset from the position of vertical alignment of the pivot points of the pendulums and the beneficial results from this invention can also be obtained by providing horizontal spacing between such pivot points. Further, the strength of magnet 28 is not critical so long as there is sufficient attraction between the magnet and element 26 to effect enough energy transfer between the pendulums to accomplish the synchronization as heretofore described. For example, a relatively weak magnet may be used if very close spacing between the magnet and the ferromagnetic element is utilized. On the other hand, if a stronger magnet is utilized, the spacing between the two magnetic elements can be increased until the desired magnetic attraction is obtained.

Although the foregoing description and explanation contemplates the control through magnetic coupling of a powered clock pendulum by a free-pendulum of a greater mass, the invention should not be restricted merely to pendulums. It is contemplated that the invention can also have applicability in the synchronizing of other harmonic motion structures through the intercoupling effect of the magnetic field generated by a permanent magnet. For example, if a second, magnet carrying balance wheel were to be added to the conventional spring driven balance wheel of a watch mechanism, a ferromagnetic element might be carried by the conventional balance wheel in a manner analagous to the relationship described herein with respect to pendulums. Synchronization of the harmonic motions of the two balance wheels could then be effected in accordance with the principles of this invention.

It will also be recognized by those skilled in the art that, if desired, the magnet and the ferromagnetic element might be reversed without departing from the spirit of the invention. In other words, the magnet may, if desired, be carried by the powered harmonic structure and the ferromagnetic element would then be carried by the free harmonic structure.

I claim:

1. Apparatus for enhancing the accuracy of a timing system including a mechanism controlled by a powered oscillating member, said apparatus comprising:

an oscillating structure having a greater mass than said member;

a magnetic attracting device including a pair of components, one of the components being carried by the member for movement therewith and the other component being carried by the structure for movement with the latter; and means mounting the structure for oscillatory movement on a path of travel bringing the components periodically into spaced apart mutually magnetically attracted relationship during oscillation of the structure and the members, whereby energy is transferred between the member and structure through the device during such relationship to govern the rate of oscillation of the member and to continue the oscillation of the structure.

2. Apparatus as set forth in claim 1, wherein said structure is physically configured to provide a period of oscillation approximately twice the period of oscillation of said member.

3. Apparatus as set forth in claim 1, wherein said device includes means for varying the position on the paths of travel of the members and structure at which said components are moved into said magnetically attracted relationship.

4. Apparatus as set forth in claim 1, wherein is included means for adjusting the spacing between said components when the latter are in said magnetically attracted relationship, whereby to alter the amount of energy transferred between the member and the structure during the time the components are in said relationship.

5. Apparatus as set forth in claim 1, wherein said member and said structure are each pendulums.

6. Apparatus as set forth in claim 5, wherein said structure is a free-pendulum.

7. Apparatus for enhancing the accuracy of a timekeeping system including a pendulum controlled, energized clock mechanism, said apparatus comprising:

a governing pendulum having a greater mass than the clock pendulum;

a magnetic attracting device having a pair of components, one of said components being carried by the clock pendulum for movement therewith, the other component being carried by said governing pendulum for movement with the latter; and means mounting the governing pendulum for oscillation on a path of travel to periodically move the components into spaced apart mutual magnetically attracted relationship as the two pendulums oscillate on their respective paths, whereby energy transferred between the pendulums through said device serves to govern the speed of oscillation of the clock pendulum and to power the oscillatory movement of the governing pendulum.

8. Apparatus as set forth in claim 7, wherein said device includes a permanent magnet component and a ferromagnetic material component.

9. Apparatus as set forth in claim 7, wherein said governing pendulum is physically configured to have a natural period of oscillation of approximately twice the period of oscillation of the clock pendulum.

10. Apparatus as set forth in claim 9, wherein the centers of pivot of the clock pendulum and of the governing pendulum are vertically aligned.

11. A method of enhancing the accuracy of a timing system including a powered oscillatory member and a free oscillatory member, said method comprising:

generating a magnetic field from one of the members capable of effecting sufficient magnetic attraction between the members for transfer of energy therebetween;

moving the members on respective oscillating paths of travel which periodically bring the members into appropriate spaced apart proximity to effect said energy transfer during oscillation;

utilizing the energy thus transferred from the powered member to the free member to continue the oscillation of the latter; and utilizing the inherent increase in speed of the powered member resulting from said energy transfer to bring the rate of oscillation of the powered member into a predetermined rate determined by the oscillation rate of the free member.

12. The method as set forth in claim 11, wherein is included the step of varying the position along the respective paths of travel at which said appropriate proximity is achieved, to adjust the synchronism of movement between said members.

13. The method as set forth in claim 11, wherein is included the step of varying the effective strength of said magnetic attraction between the members, to adjust the synchronism of movement between the members.

* * * * *